US006666331B2

(12) United States Patent
Archer

(10) Patent No.: US 6,666,331 B2
(45) Date of Patent: Dec. 23, 2003

(54) BOTTLE CARRIER

(75) Inventor: Michael John Archer, London (CA)

(73) Assignee: Labatt Brewing Company Limited, London (CA)

( * ) Notice: Subject to any disclaimer, the term of this patent is extended or adjusted under 35 U.S.C. 154(b) by 0 days.

(21) Appl. No.: 09/994,825

(22) Filed: Nov. 28, 2001

(65) Prior Publication Data

US 2003/0098254 A1 May 29, 2003

(51) Int. Cl.[7] ..... B65D 65/00

(52) U.S. Cl. ..... 206/427; 206/155; 206/147

(58) Field of Search ..... 206/147, 150, 206/153, 155, 427

(56) References Cited

U.S. PATENT DOCUMENTS 2,738,871 A * 3/1956 Vander Lugt, Jr. ..... 206/427
4,386,698 A * 6/1983 Klygis ..... 206/432
5,263,633 A * 11/1993 Bicksler et al. ..... 229/109
5,947,367 A * 9/1999 Miller et al. ..... 229/182.1

* cited by examiner

*Primary Examiner*—David T. Fidei

(57) ABSTRACT

A paperboard partitionless carrier is provided for containing filled beverage bottles. The carrier comprises a pair of spaced side walls joined by a pair of end walls to form a box structure which, in combination with a base, forms a tray which supports the bottles. The carrier also has bottle restraining means overlying and contacting the sealed necks of the bottles thereby preventing the bottles being opened and the bottles being extracted from the carrier without the material forming the carrier being visibly interfered with.

9 Claims, 3 Drawing Sheets

BOTTLE CARRIER

FIELD OF INVENTION

This invention relates generally to paperboard carriers for use in packaging articles and, more particularly, sealed bottles containing a liquid, especially, a beverage such as beer or soft drinks.

BACKGROUND OF THE INVENTION

Carriers are secondary containers which are widely used in the beverage industry to facilitate transporting beverages such as soda and beer packaged in primary containers, usually cans and bottles. Many carriers are of the fully enclosed type, that is the carrier totally encloses the primary containers is one such container shown in U.S. Pat. No. 3,554,402. Carriers of this type provide, inter alia, protection for the beverage against possible adverse effects of light and also security against product tampering since it can readily be noticed if the secondary package has been interfered with in order to gain access to one of the enclosed primary containers. However many carriers especially those which accommodate bottles, are what are known as "basket carriers" which are generally fully open at the top thereby exposing the bottles which are supported from below and, generally, each bottle has its own compartment or cell. If such a carrier is tipped, it is possible for one or more of the bottles to fall out moreover since some or all of the bottles may be extracted and re-inserted without leaving any indication, this could pose a security risk as far as possible tampering of product is concerned. Examples of such cartons are described in U.S. Pat. Nos. 2,721,001 and 4,319,682. Another type of carrier is called a "wrap-around" since it is formed by folding a strip of material around a number of bottles and its ends are then secured to form a sleeve enclosing the bottles. The ends of the package may be open and this can cause various problems and, in particular, bottles may be relatively easily dislodged or extracted from the package without the package material being noticeably changed. A carrier of this type is described in U.S. Pat. No. 5,593,027. The loss of a bottle from the pack and thereby loss of a sale of the unit is a problem but also there is a possible lack of security in that there is increased risk that an extracted bottle may be deliberately tampered with and returned to the package leaving no indication it has happened.

Unlike cans, conventional beverage bottles are typically of substantially the same diameter from the base to the midsection or shoulder and then tape into a smaller diameter neck. This design allows a bottle to be relatively readily eased out of the carrier vertically or horizontally and, to some extent, it can be angled as it exists a cell or the sleeve.

The question of product integrity is of increasing concern especially in view of the increased use of bottle closures which, for convenience, are more easily removed and without obvious visible signs and can be re-applied more evenly than for example, the traditional "crimped on" crown closures. Traditionally applied crown using crimped-on crowns or capsules has rendered each individual bottle somewhat secure. As indicated, closed carriers by their nature also guard against this possibility.

However, it is highly desirable in the beverage industry in some instances to use a package which provides that substantial portions of the bottled beverage are exposed to the consumer. This allows the consumer to see the neck and the whole or part of the body label which, in combination with the bottle colour and shape, are esthetically pleasing. The ability to do this is considered very important by marketters since a distinctly shaped bottle, perhaps in combination with colour and design elements, associated with the product, can readily and immediately impart the desired message of product identification to the consumer.

In addition, there are a number of situations when it is necessary or desirable to produce retail packages of beverages by hand, for example, to produce four-packs of beer in small amounts for special promotions or in small amounts which are not produced economically on present day high volume equipment.

It is an objective of the present invention to provide a carrier for filled and sealed beverage bottles which carrier provides easier visual access to the bottles whilst rendering removal and reinsertion of a bottle from a filled carrier without leaving a visible indication thereof very difficult.

It is a further object of the present invention to provide simple an inexpensive bottle carrier which can easily be filled manually and which provides wide visual exposure to the enclosed bottles and the associated graphics and other indicia carried thereon.

SUMMARY OF INVENTION

The present invention provides a bottle carrier which includes a tray-like base which can support a complement of filled and sealed bottles which, in combination with a bottle restraining system, which can comprise one or more straps which overlies each bottle and prevents each bottle top from being accessed, and each bottle from being extracted from the carrier, without the carrier being damaged in a manner which is readily visible. The restraining system is also designed to allow wide visual expose to the bottles. The carrier can readily and inexpensively be produced in one piece and manually filled rapidly and easily.

The carrier of the invention lends itself to use with small numbers of bottles for example six or less but especially four or less. The circumference defined by the side and end walls is chosen so that, when the full complement of bottles is placed in the carrier, they are held tightly and essentially precluded from moving laterally.

The height of the side or end walls may vary provided, of course, it fills the required function namely, prevents lateral movement of the bottles. It is preferably less than half the height and especially less than one third of the bottles to be enclosed in the carrier. In this way, a significant proportion of the enclosed bottles and indicia and the like they carry are able to be viewed.

The bottle restraining means is preferably a strap extending from a side wall or end wall in combination with a panel or panels which overlies or overlie the sealed openings of bottles in the carrier. For convenience, a single panel overlying all the bottles is preferred but this is not essential. For example, in a carrier for four bottles arranged in two rows of two, there might be two narrow top panels, each overlying two bottles, the top panels being maintained in position by one strap connected to opposing side walls or end walls or two pairs of straps, each pair maintaining one top panel in place.

Each bottle is restrained by engaging means on the top panel, the means being, for example, a cut-out or a "dome" or bulge in the material which receives a bottle top preventing unsealing of the bottle unless the restraint is visibly tampered with. Essentially, the bottle would need to be removed from the carrier and the system ensures this is not possible with irreparably damaging the carrier.

DETAILED DESCRIPTION OF INVENTION

In one aspect the present invention provides a paperboard carrier for sealed beverage bottles said carrier comprising: a pair of spaced substantially parallel side walls; a pair of spaced end walls connected to ends of said side walls to form a preferably rectangular continuous perimeter member; a base member connected to a lower edge said side and/or end walls so as to form a tray member to support the bottles and maintain adjacent bottles in contact; and bottle restraining means comprising a strap member extending from an upper edge of each side wall or each end wall away from the base member to a top member which overlies and contacts each sealed bottle opening, each said strap members having a width less than a length of its associated side wall or end wall, said bottle restraining means being adapted, in combination with said base to engage and prevent unsealing of a little when in, and extraction of a bottle from, the filled carrier without causing visible change, and in particular, damage, to the carrier.

In a preferred embodiment, the invention provides a paperboard carrier for four sealed beverage bottles, said carrier comprising; a pair of spaced substantially parallel side walls; a pair of spaced substantially parallel end walls connected to ends of said side walls to form a rectangular perimeter; a base member connected to said side and/or end walls so as to form a tray member to support the bottles; and bottle restraining means comprising a strap member extending from an upper edge of each side wall or each end wall away from the base member to a member which overlies and contacts each sealed bottle opening, each said strap members having a width less than a length of its associated side or end wall, said bottle restraining means being adapted, in combination with said base to engage and prevent unsealing of a bottle in, and extraction of a bottle from, the filled carrier without causing visible change, and in particular, damage, to the carrier.

In another aspect, the invention provides a one piece blank for producing the carrier of the invention.

The present invention further provides a retail beverage pack comprising a carrier of the invention containing a full compliment of sealed bottles filled with a beverage and sealed. Finally, according to the present invention, there is provided a retail beverage package including a paperboard carrier comprising a pair of spaced substantially parallel side walls; a pair of spaced end walls connected to ends of said side walls to form a continuous perimeter; a base member connected to a lower edge of said side walls or end walls so as to form a tray member which supports a full complement of whose openings are sealed bottles filled with a beverage and which maintains immediately adjacent bottles in contact and bottle restraining means comprising a strap member extending from an upper edge of each side wall or end wall to a top member which overlies and contacts a sealed opening of each bottle, each of such strap members having a width less than a length of it's associated side wall or end wall, said bottle restraining means being adapted in combination with said base to engage and prevent unsealing of a bottle in and extraction of a bottle from, said carrier without causing visible change such as damage, to the carrier.

Other advantages and objects of the present invention will be apparent from the following description, the accompanying drawings and the appended claims.

Figure 1:
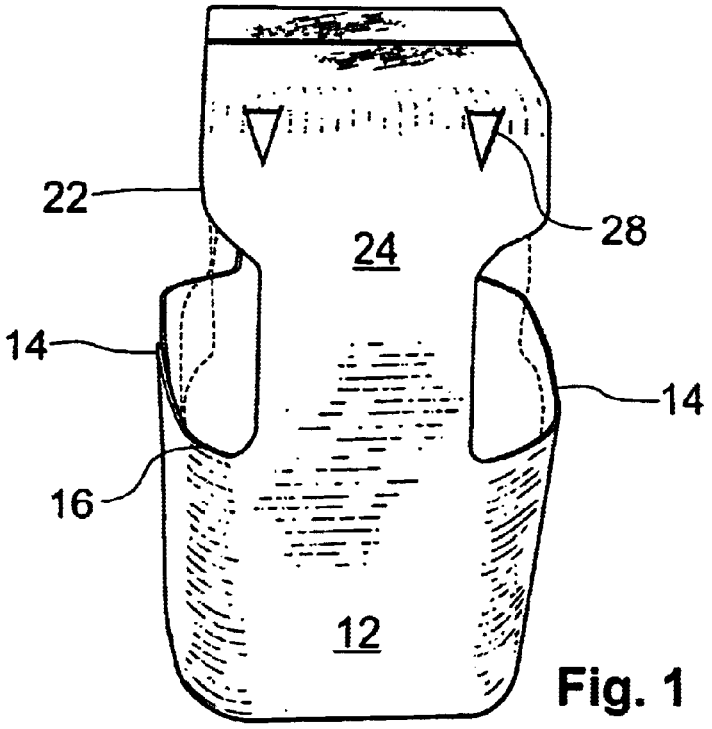
FIG. 1 is a side elevation of a carrier according to the invention for use to contain four beer bottles.
Figure 2:
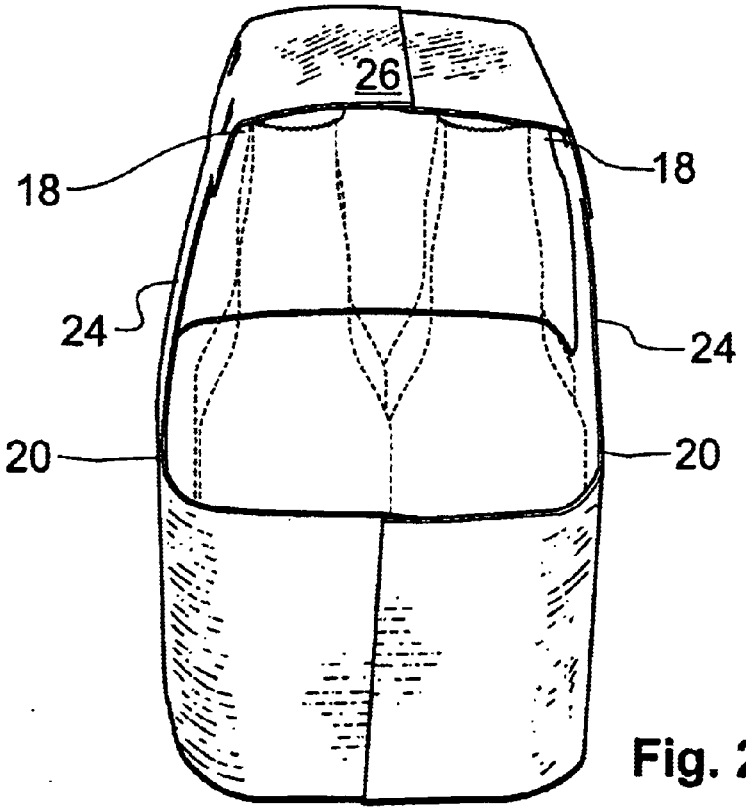
FIG. 2 is an end elevation of the carrier of FIG. 1.
Figure 3:
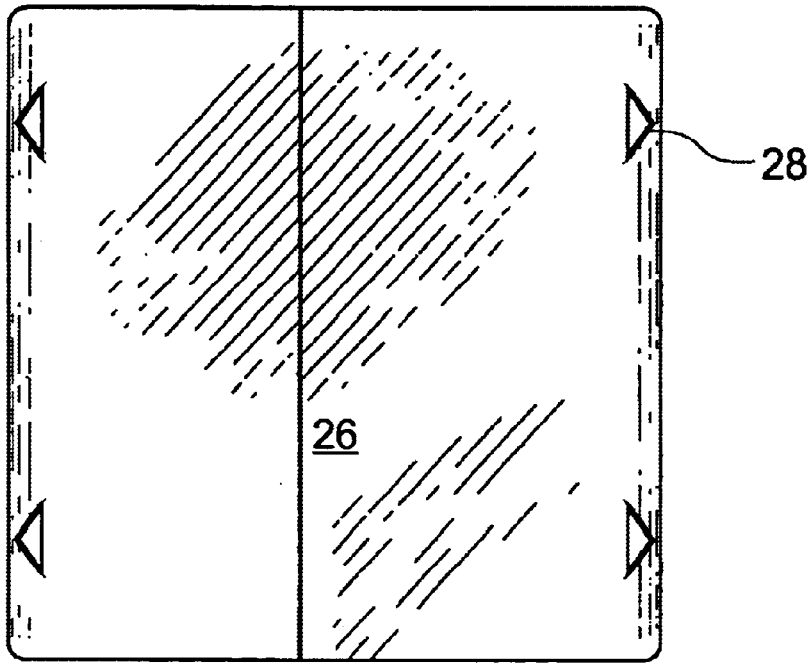
FIG. 3 is a plan view from above of the carrier of FIG. 1.

Turning to the FIGS., the carrier of the present invention, generally designated 10, has opposing side panels or walls 12 and opposing end panels or walls 14. Extending upwards from upper edge 16 of side panel 12, over and contacting the crowns 18 sealing bottles 20, to the upper edge 16 of the opposing side wall 12 is bottle restraining member generally designated 22. The latter comprises arms or straps 24 and top 26. Cut out of arms 24 at about their juncture with top 26 are V-shaped cut-outs 28, the width of the base of the V being chosen to allow entry of and engage part of the crown 18 of an enclosed bottle 20. Bottle restraining member 22 is tightly drawn over the bottles 20 as can be shown by the fact the arms 24 are angled from the vertical to take into account the fact the bottle shoulders are narrower than the bottle neck. It will be appreciated that the interior height from the base to the top of the bottle-retaining member is carefully chosen to ensure that this tight fit occurs. As a consequence, the crowns 18 are securely engaged within cutouts 28.

Figure 4:
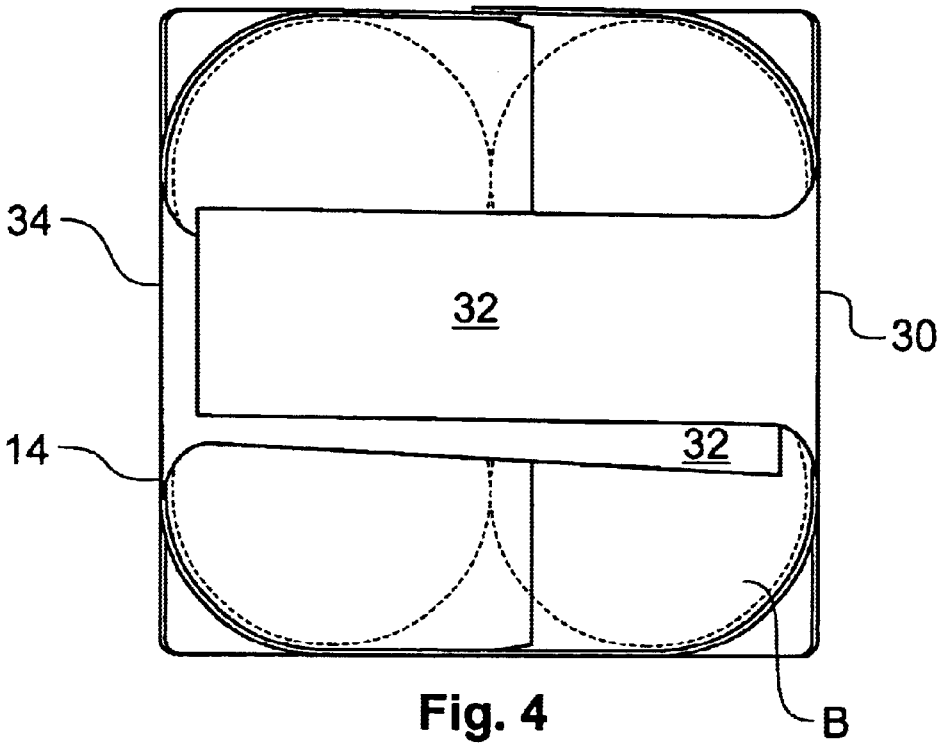
FIG. 4 is a plan view of the base of the carrier of FIG. 1.
Figure 5:
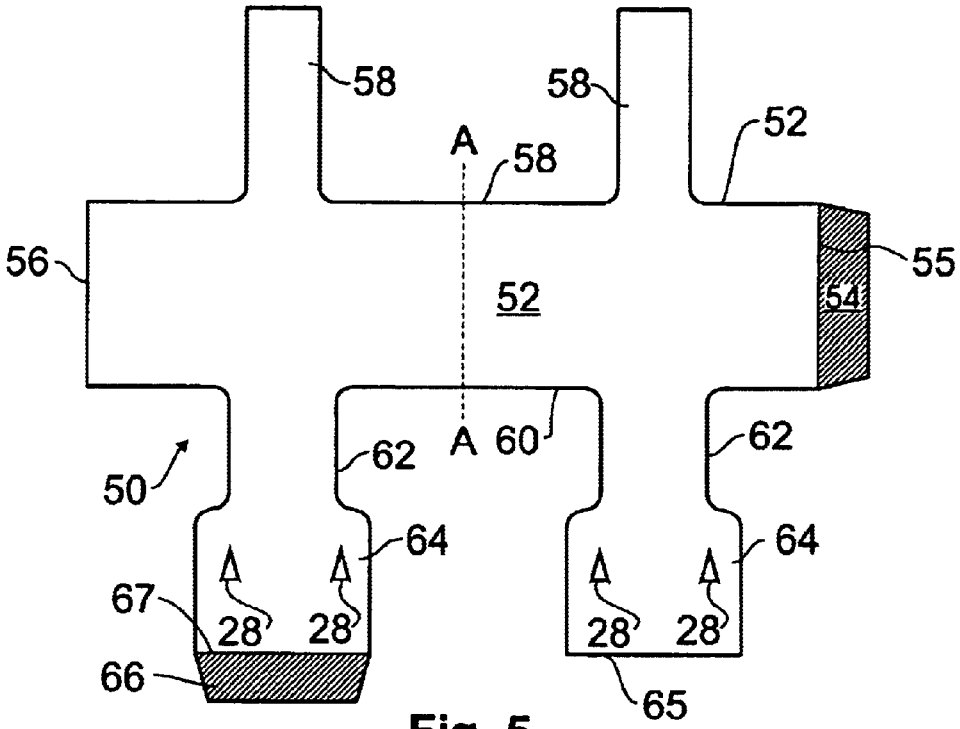
FIG. 5 is a plan view of a carrier blank according to the present invention as initially found.

The base 30, refer FIG. 4 is made up of two straps 32, each extending from the lower edge 34 and of an associated side panel 14. The straps 32 being shown slightly displaced i.e. out of exact register. As can be seen, the base formed by members 32 does not extend across the full area of the carrier but leaves parts of the base area open leaving a part of each of the four enclosed bottles visible. However the base 30 formed by members 32 contacts a sufficient amount of each bottle to support them maintain that they are in contact with the carrier top 26. Where the straps 32 overlap, they are secured via an adhesive not visible. It should be noted that the interior of the carrier is not divided into cells or compartments. Immediate adjacent the bottles fit snugly with immediately adjacent bottles being in contact with each other and consequently all are unable to move. In the four pack shown, diagonally related bottles do not contact each other. As a consequence of the combination of the secure engagement of each crown 18 in an associated cut-out 28 and the bodies of the bottles essentially being immobilized by the side walls/end walls/base combination, each crown 18 cannot be removed from the carrier without tearing of the carrier material. Moreover, a major portion of each bottle is clearly visible. Turning to FIG. 5, this shows a one piece blank, generally designated 50, which comprises an elongate panel 52 carrying along one edge, glue tab 54. Tab 54 can be secured via an adhesive to the other side of panel 52 adjacent edge 56 to form the formed flat carrier ready for use. Panel 52 provides the two side walls 12 and two end walls 14 although such walls are not specifically delineated via hinge lines, lines of weakness or the like.

Extending perpendicularly from one edge 58 of panel 52 are two strips 59 which when secured together in an overlapping relationship form the bottle support base member. Also extending perpendicularly from panel 52 but from its edge 60 are two strap members 62, each of which carries at another and opposite edge part top member 64. Each member 64 is provided with two V-shaped cutouts 28, one for each bottle to be contained within the four-bottle carrier. One part top member 64 is provided with a tab 66 which, in combination with adhesive, allows the two part top members 64 to be seamed together to complete formation of top member 26 in the set up carrier. It will be noted that in this embodiment, one base strip 58 and one strap 62 extend from edges 58 and 60 of panel 52 and directly opposite each other. In fact the area directly between each pair of straps 58 and 62 will constitute an end wall in the set-up carrier whilst the panel area between those side wall areas will constitute one end panel, the other will be formed by the securing of tab 54 to the (not shown) side of panel 52 adjacent edge 56.

Figure 6:
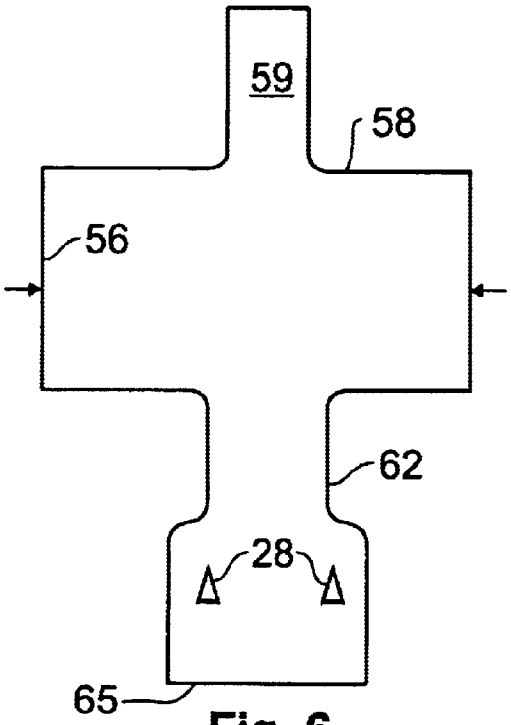
FIG. 6 is a plan view of the blank of FIG. 5 partially assembled and in the "knocked down" or "flat" condition ready, following set-up, to received full bottles.

Essentially, to convert the blank 50 to the flat version shown in FIG. 6, the manufacturer applies adhesive to the shaded areas of tabs 54 and 66; these tabs are rotated about their respective hinge lines 55 and 67 and the panel 52 is bent and rotated above line 52 so as to have the glued areas of tabs 54 and 66 lie against the other sides of panel 52 adjacent edge 56 and part top member 62 adjacent edge 65 of the other part top member 62. The end result is shown in FIG. 6. Note that the panel 52 has been converted into a continuous loop of board. Also the two-part top members 64 are now joined to form the complete top member 26. It should be noted that the two base strips 59 are not joined to each other.

To set-up the carrier and prepare the retail beverage package of the present invention, the flat carrier as shown in FIG. 6 is squeezed in the direction of the arrows. This action opens the flattened loop consisting of the side walls and end walls and, simultaneously separates and spaces the strap 62 and form the top 26. The so prepared carrier is then inverted and filled with a full complement of four sealed bottles containing the desired beverage, the bottles being in an inverted orientation at that time. Finally, adhesive to one surface of a strip 59 which will abut a surface of the other base strip 59 bottom folded when over in sequence about the line of attachment to their associated side wall edge 58 so as to overlie—refer FIG. 4—and become secured together. It is important that strip 59 is pulled tightly so as to contact the bottoms of the bottles prior to the strips being secured together to ensure that a part of each sealed bottle top which is seated in its associated cut-out 28 cannot disengage because the bottles cannot move sufficiently from the top 26. This makes the extradition of a bottle without effecting visible change, especially damage, the material of the carrier as difficult as possible. Further, it would be clear if an attempt had been made to open and reseal a bottle in the carrier.

The one-piece blank 50 is made of paperboard namely regular carton board obtained from Mead Packaging Company, Canada. It may be noted that using this type of relatively flexible paperboard, the side and end walls will automatically conform to the shape of the bottles as they are inserted into the erected carrier and retain same in a tightly bunched contacting relationship. There is no need to provide lines of weakness, score lines or the like.

The height of the side walls 12 and end walls 14 is critical only insofar as, when the carrier is erected, there is a "tray" formed by the said walls and the base which tightly holds the bottles together when held in place in the "tray" by the bottle retaining member 24 preventing bottle movement sideward away from the base 32. As described above, movement upwardly from the base is also prevented upon the base being formed from strips 59. The blank is conveniently formed by cutting in the usual manner from a single sheet of paperboard. Subsequently sealing using a regular adhesive of tabs 54 and 66 complete formation of the side and end wall perimeter and the bottle restraining strap 62 and top 26 respectively. The collapsed blank is provided to the customer in that condition. The filled carrier is then turned over so as to lie in its normal orientation with the contents resting on the secured bottom strips 59 forming the base 32. It may be left in this condition for a period to ensure the adhesive fully sets. Obviously, the type of adhesive (eg. hot melt adhesives are common in this field) used would dictate the period required to form the desired bond between the various secured board members and this would be readily apparent to one skilled in the art.

The present invention has been described in detail with respect to beverages. However it will be appreciated that the carrier can be used to advantage with respect to primary containers containing other liquids etc. where similar concerns exist.

It will be understood that the above description of the present invention is susceptible to various modifications, changes and adaptations, and the same are intended to be comprehended within the meaning and range of equivalents of the appended claims.

I claim:

1. A paperboard carrier for sealed beverage bottles, each bottle having a sealed bottle opening, said carrier comprising:

a pair of spaced substantially parallel side walls; a pair of spaced end walls connected to ends of said side walls to form a continuous perimeter member; a base member connected to a lower edge of said side and/or end walls so as to form a tray member to support the bottles when in said carrier and maintain adjacent bottles in contact; and bottle restraining means comprising strap member extending from an upper edge of each side wall or each end wall away from the base member to a top member which is adapted to overlie and contact each sealed bottle opening via engaging means selected from the group consisting of a cut out, dome or bulge, each such cut out, dome or bulge being adapted to engage a sealed bottle opening of an associated bottle when in the carrier, the number of such cut outs, domes or bulges being equal to the number of bottles which constitute a full complement of bottles, each said strap member having a width less than a length of its associated side or end wall, said bottle restraining means being adapted, in combination with said base to engage and prevent unsealing of a bottle when in, and extraction of a bottle from, the filled carrier without causing visible change to the carrier.

2. A paperboard carrier for sealed beverage bottles, each bottle having a sealed bottle opening, said carrier comprising:

a pair of spaced substantially parallel side walls; a pair of spaced substantially parallel end walls connected to ends of said side walls to form a continuous rectangular perimeter member; a base member connected to a lower edge of said side and/or end walls so as to form a tray member to support the bottles when in said carrier and maintain adjacent bottles in contact; and bottle restraining means comprising a strap member extending from an upper edge of each side wall or each end wall away from the base member to a member which is adapted to overlie and contact each sealed bottle opening via engaging means comprising a cut out, each such cut out being adapted to engage a sealed bottle opening of an associated bottle when in the carrier, the number of such cut outs being equal to the number of bottles which constitute a full complement of bottles, each said strap member having a width less than a length of its associated side or end wall, said bottle restraining means being adapted, in combination with said base to engage and prevent unsealing of a bottle when in, and extraction of a bottle from, the filled carrier without causing visible change to the carrier.

3. A retail beverage package including a paperboard carrier and a full complement of bottles having openings which are sealed comprising a pair of spaced substantially parallel side walls; a pair of spaced substantially parallel end walls connected to ends of said side walls to form a continuous rectangular perimeter member; a base member connected to a lower edge of said side walls or end walls so as to form a base member which supports the full complement of bottles, and which perimeter member maintains immediately adjacent bottles in contact and further bottle restraining means comprising a strap members extending from an upper edge of each side wall or end wall to a top member which overlies and contacts via engaging means selected from the group consisting of a cut out, dome or bulge, a sealed opening of an associated bottle, each of such strap members having a width less than a length of it's associated side wall or end wall, said bottle restraining means being adapted in combination with said base to engage and prevent unsealing of a bottle in, and extraction of a bottle from, said carrier without causing visible change to the carrier.

4. A retail beverage package comprising a carrier according to claim 1 or 2 confining within a full complement of sealed bottles containing a beverage.

5. A carrier according to claim 1 wherein said perimeter is a rectangle.

6. The carrier according to claim 1, 2 or 3 wherein the height of the side walls is less than one half the height of the said bottles.

7. The carrier according to claim 1, 2 or 3 wherein the height of the side walls is less than one-third the height of the said bottles.

8. The carrier according to claim 1 or 2 wherein each strap members extends from a central portion of an upper edge of an associated wall member and said top member is a single panel adapted to overlie all said sealed bottle openings.

9. A blank for producing the carrier as claimed in claim 1.

* * * * *